US009091028B1

(12) United States Patent
McCary, Sr.

(10) Patent No.: US 9,091,028 B1
(45) Date of Patent: Jul. 28, 2015

(54) VERTICAL CONCRETE SCREED AND ROLLING TOOL

(71) Applicant: John Milner McCary, Sr., Birmingham, AL (US)

(72) Inventor: John Milner McCary, Sr., Birmingham, AL (US)

( * ) Notice: Subject to any disclaimer, the term of this patent is extended or adjusted under 35 U.S.C. 154(b) by 0 days.

(21) Appl. No.: 13/998,862

(22) Filed: Dec. 16, 2013

(51) Int. Cl.
*E01C 19/22* (2006.01)
*E01C 19/00* (2006.01)
*E01C 19/43* (2006.01)
*E01C 23/02* (2006.01)

(52) U.S. Cl.
CPC ..... *E01C 19/002* (2013.01); *E01C 19/43* (2013.01); *E01C 23/025* (2013.01)

(58) Field of Classification Search
CPC ..... E01C 23/025; E01C 19/43
USPC ..... 404/89, 93, 103, 113–115, 118
See application file for complete search history.

(56) References Cited

U.S. PATENT DOCUMENTS 4,663,796 A * 5/1987 Helling et al. ..... 15/144.2
5,234,283 A * 8/1993 Adkins ..... 404/97
5,687,448 A * 11/1997 Dye, Jr. ..... 15/235.8
6,139,217 A * 10/2000 Reuter ..... 404/97
6,374,569 B1 * 4/2002 Suckow ..... 52/749.13
6,524,175 B2 * 2/2003 Beaudry et al. ..... 451/524
6,550,214 B2 * 4/2003 Aguilera ..... 52/749.13
7,156,577 B1 * 1/2007 Rozinski ..... 404/114
7,204,659 B2 * 4/2007 Schmitt et al. ..... 404/118
2005/0036837 A1 * 2/2005 Marshall ..... 404/114
2005/0276156 A1 * 12/2005 Elsten ..... 366/117
2007/0201302 A1 * 8/2007 Lindley ..... 366/123
2010/0139196 A1 * 6/2010 Healy ..... 52/365
2010/0288520 A1 * 11/2010 Dayton et al. ..... 173/1
2011/0217121 A1 * 9/2011 Argento et al. ..... 404/118
2012/0183351 A1 * 7/2012 Brening ..... 404/114

* cited by examiner

*Primary Examiner* — Raymond W Addie

(57) ABSTRACT

The present invention is a manufactured screed, smoothing, finishing and decorative rolling toll applied to vertical surface fresh concrete/cementous material. The screed/decorative rolling of a vertical fresh concrete surface demands more adjustments in blade or roller angle of the screed/decorative rolling tool than what is needed for horizontal fresh concrete. The vertical concrete surface screed/decorative rolling tool operator can in most applications efficiently and effectively vertically screed, smooth, finish and/or decorative roll concrete without tiring too quickly. The vertical concrete screed/decorative rolling tool can be adjusted and be fixed to numerous blade or roller angles of adjustments in relation to the pole/handle by the screed/rolling tool multi-axis connection head. A vibrator attaching point is manufactured on the multi-axis connection head.

5 Claims, 3 Drawing Sheets

Figure 1:
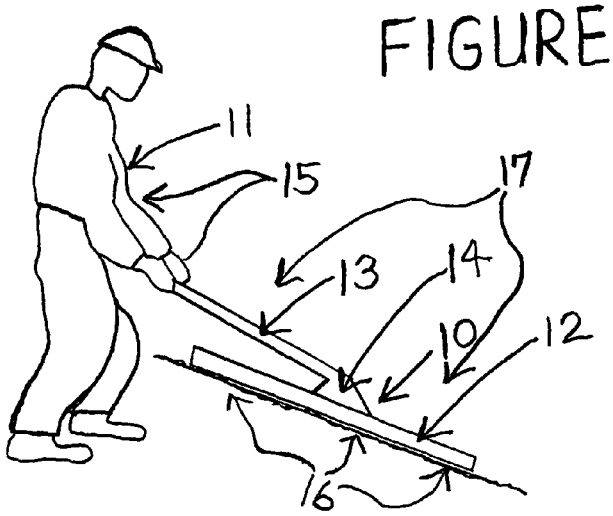
FIGURE 1 PRIOR ART

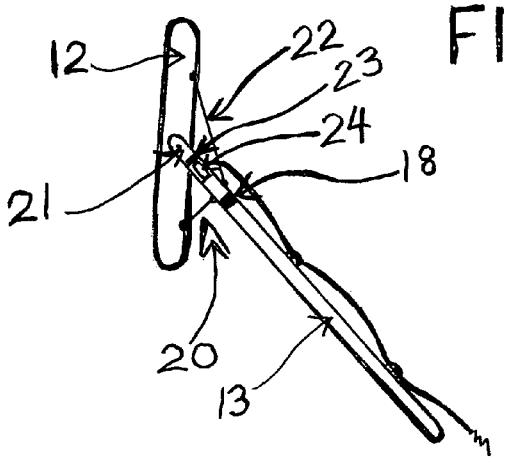
FIGURE 3.
FIGURE 5.
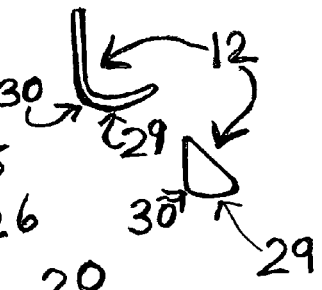
FIGURE 4.
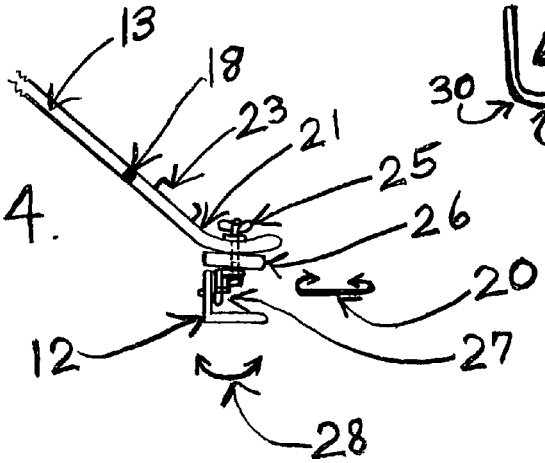

VERTICAL CONCRETE SCREED AND ROLLING TOOL

FIELD OF THE INVENTION

The present invention relates to a fresh concrete/cementous material vertical surface screed, smoothing, finishing and decorative rolling tool.

BACKGROUND OF THE INVENTION

A number of tools are used to screed and smooth finish horizontally or flat placed fresh concrete. In most horizontal/flat wet concrete screeding and smoothing applications where a pole or handle is attached to the screeding/smoothing blade or roller, the screeding tool operator is in a fairly upright standing position, walking backwards, facing the screed/smoothing tool. The operator pulls the screeding/smoothing blade/roller across the un-screeded/smoothed concrete, leveling, smoothing, finishing and compacting the pulled over fresh concrete. The screeding/smoothing tool blade or roller end may be vibrated by some vibratory means to assist in screeding/smoothing the concrete.

A roller may also be used on horizontal fresh concrete when there is the desire for decorative application treatments. The decorative roller may be used in an application to press in a concrete stencil into a fresh concrete surface. Another decorative roller application may be where a pattern is imprinted on the roller where when the roller is rolled over the horizontal fresh concrete the roller pattern is left on the face of the concrete.

Most all of the existing horizontal flat concrete screed/decorative rolling tool blades or rollers are in a fairly fixed position as to the angle of the blade or roller to the pole or handle, vertically or laterally, and cannot be readily adjusted to allow the blade or roller to be rotated and fixed into a new angle in relation to the axis of the pole or handle. In horizontal flat fresh concrete screed/decorative rolling there is usually not a need for multi-axis rotation of the blade or roller due to the position of the tool operator being fairly "squared up" pulling and/or pushing in an applied force perpendicular to the longitudinal surface of the blade or roller.

A significant amount of the horizontal screed/smoothing and decorative rolling tool weight can be placed on the horizontal flat fresh concrete surface such that the screed/decorative tool operator is not having to carry the majority of the horizontal tool weight. In most of the horizontal/flat concrete screed/decorative rolling tool application approximately ½ to ⅔rds of the tools weight is placed on the horizontal flat fresh concrete surface. The ability for the horizontal fresh concrete to carry much of the screed tool load is very beneficial to vibrating screed/rolling tools especially when the vibrating power motor is placed closed to the blade or roller.

Screed, smoothing, finishing and/or decorative rolling a vertical fresh concrete surface is significantly different and usually more difficult taking more concentration by the vertical screed/decorative tool operator to screed/decorative roll than on a horizontal flat concrete surface. When attempting to screed or roll vertical fresh concrete the tool operator needs to continually align the vertical screed/rolling tool blade or roller in the right angle with the plane of the surface of the fresh concrete, while maintaining effective pressure on the vertical tool, pulling, drawing or pushing the vertical screed/rolling tool. The vertical surface may be above the operator's chest height, equal to or below his chest height, at angles many times difficult for the vertical tool operator to continually maintain. Also the vertical surface(s) may have various turns and angles. The vertical screed/rolling tool cannot be so heavy, especially at the blade or roller end, that the vertical screed/decorative rolling tool operator tires too quickly.

What is needed is a screed, smoothing, finish and decorative rolling tool that has enough blade, roller, pole/handle adjustments that allows the tool operator to screed/decorative roll the vertical fresh concrete at a comfortable and efficient alignment/angle(s). The vertical screed/decorative rolling tool needs to be also efficient and light enough to not over burden the tool operator.

SUMMARY OF THE INVENTION

The invention entails a manufactured assembly and method of operation of a vertical fresh concrete screed, smoothing, finishing and decorative rolling tool. The invention entails a tool operator pole or handle with a screeding blade, trowel or roller attached at one end that would allow the tool operator to effectively and efficiently screed, smooth, finish or decorative roll vertical fresh concrete/cementous material surfaces. The screed blade and/or roller is able to be adjusted and fixed into position in at least two to maybe three axes in relation to the operator pole/handle by the multi-axis connection head attaching points that the blade or roller is attached. The multi-axis connection head is attached between the pole or handle and the blade or roller. The first angle of adjustment is for the blade or roller to be able to rotate by the multi-axis connection head such that the plane of the longitudinal surface of the blade or roller can be rotated and fixed into various angle positions as to the axis of the pole or handle of the vertical screed/rolling tool. Secondly the blade or roller can be rotated and adjusted by the multi-axis connection head in a desired angle in relation to the screed/rolling tool pole/handle up or down as to the concrete surface working plane of the blade or roller.

The vertical fresh concrete screed/roller tool blades or rollers may need to have adjustable struts that extend out from the multi-axis connection head to the blade or roller. The vertical screed/rolling tool will also have a flex or cushion vibration absorbing joint(s) between the pole/handle and the multi-axis connection head that allows the blade or roller to slightly flex over bumps, dips, turns or corners on the vertical fresh concrete surface. The vertical screed/rolling tool has a vibration source attaching point manufactured on the multi-axis connection head where a vibration source can assist in screeding/rolling the vertical fresh concrete/cementous material surface. The flex/cushion vibration absorbing joint(s) also helps isolate vibration of the blade or roller from the vertical screed/decorative rolling tool pole or handle.

I some vertical fresh concrete finishing applications it would be desirable to place stencils on to the fresh vertical concrete. It would be beneficial to be able to roll in the placed stencils with a correctly aligned roller to the vertical surface. It also could be very beneficial, especially in long run vertical applications, to have a stencil feed roll attached to the stencil pressing roller. Another decorative roller application to vertical fresh concrete is to have a roller with a pattern made into the surface of the roller that when the roller is press rolled over the

BRIEF DESCRIPTION OF THE INVENTION

FIG. 1 shows in a side perspective view a horizontal flat style screed being used in the usual backing up method smoothing fresh flat concrete.

Figure 2:
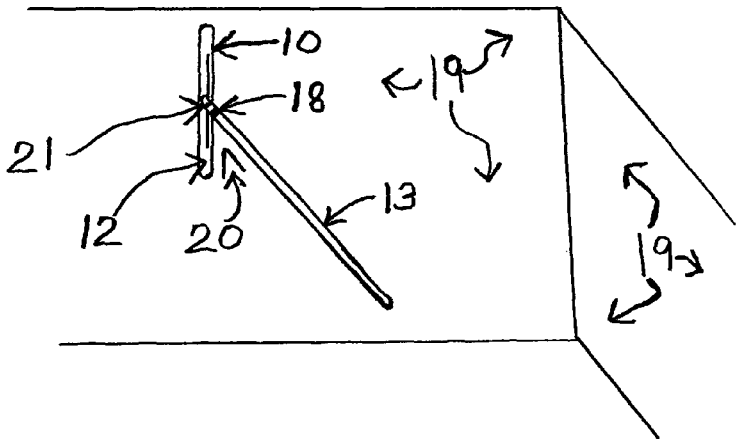

FIG. 2, in a front perspective view, is shown an application using the vertical surface screed, smoothing, finishing and decorative rolling tool with an attached blade.

Shown in FIG. 3 in an overhead view are the vertical surface screed/decorative rolling tool with adjustable struts and attached blade and vibrator.

FIG. 4 shows in a side view the vertical surface screed/smoothing, finishing and decorative rolling tool showing the pole or handle optional adjustments with an attached blade.

FIG. 5, in a side view, shows the rounded working surface and leading edge of the vertical screed, smoothing, finishing and decorative rolling tool blade.

Figure 6:
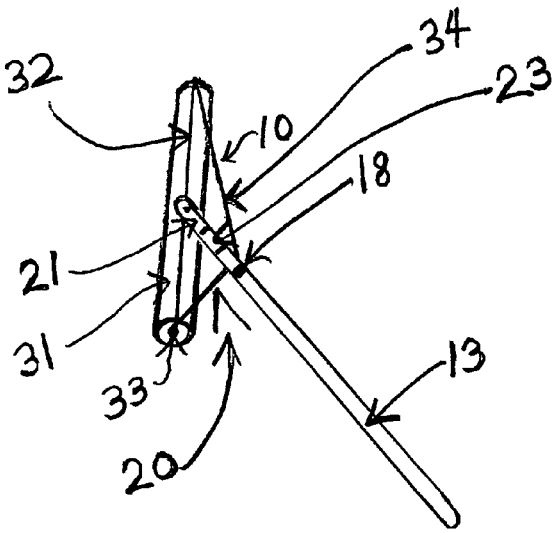

Shown in FIG. 6, in an overhead perspective view is a roller connected to the multi-axis head attaching point of the vertical concrete screed, smoothing, finishing and decorative rolling tool.

Figure 7:
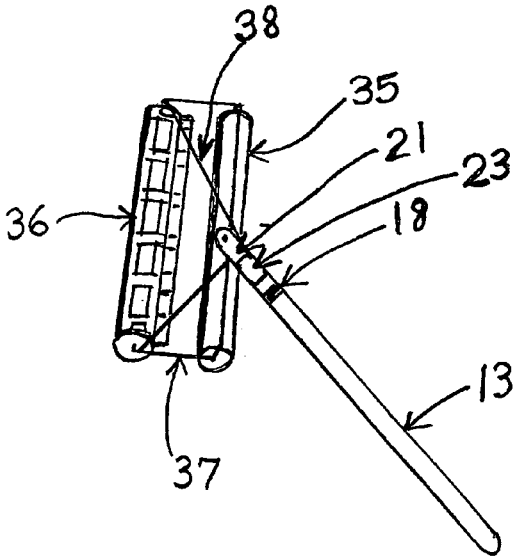

FIG. 7, in an overhead perspective view, is a decorative stencil pressing roller with a stencil feed roller connected to the pressing roller, which is attached to the attaching point of the vertical screed, smoothing, finishing and decorative rolling tool.

DETAILED DESCRIPTION OF THE INVENTION

FIG. 1 shows in a side perspective view a customary horizontal or flat screed/smoothing application. The screed/smoothing tool 10 is held by the operator 11 with the blade (or roller) 12 being pulled backward by the operator pulling the pole or handle 13 which is usually attached in a none adjustable fixed position 14 to the blade or roller, with the operators body facing fairly square 15 to the screeding tools blade or roller. The operator walks backwards over the un-screeded/smoothed fresh concrete 16 and with the blade or roller screed/smoothes over and the fresh concrete 17.

Shown in FIG. 2, in a front perspective view, is a vertical fresh concrete surface screed, smoothing, finishing and decorative rolling tool in a screed/smoothing application. The vertical screed/decorative rolling tool 10 is shown with attached blade 12 and operator handle 13. The flex cushion vibration absorbing joint(s) 18 on the pole is shown that allows the blade or roller to flex over irregularities and bumps in the fresh concrete vertical surface 19. The vertical screed/decorative rolling tool has various adjustable angles 20 between the pole or handle 13 and the blade (and roller, if attached) 12 by the angle adjustable multi-axis connection head 21. Further showing in more detail the vertical fresh concrete screed/decorative rolling tool in FIG. 3, in an overhead view, is shown the blade 12, operator pole or handle 13 and the flex cushion vibration absorbing joint. Again shown is an angle 20 between pole/handle and the blade of the vertical screed/decorative rolling tool allowed by the adjustable multi-axis connection head 21. Adjustable stabilizing struts 22 are shown attached to the blade 12 and to the multi-axis connection head 21. A vibrator attaching point 23 for a possible attached vibrator 24 is shown manufactured on the multi-axis connection head 21.

FIG. 4, in a side view, shows the pole/handle 13, flex cushion vibration absorbing joint 18, possible angle of adjustments 20 of the blade (or roller) to the pole or handle 13 facilitated by the multi-axis connection head 21, the vibrator attaching point 23 of the vertical surface concrete screed/decorative rolling tool. Further shown is the tightening mechanism 25 of the multi-axis connection head adjustable attaching point assembly 26 and 27 for attaching and adjusting the blade or roller to various angles 20, 28. FIG. 5 shows in a side view the slightly rounded bottom 29 and leading edges 30 of two screed/smoothing blade types 12 of the vertical surface concrete screed/decorative rolling tool.

FIG. 6 shows in an overhead perspective view a roller 31 attached to the multi-axis connection head 21 of the vertical concrete screed/decorative rolling tool 10. A roller cross frame 32 connects at either center end 33 of the roller 31 and to the multi-axis connection head 21. The roller adjustable stabilizing struts 34 are attached to the roller cross frame 32 and to the multi-axis connection head 21. The vibrator attaching point 23, flex cushion vibration absorbing joint 18 and the pole or handle 13 are shown. Again is shown one of many possible angles 20 that the multi-axis connection head 21, along with stabilizing adjustable struts 33, allows the roller 31 to be rotated and be fixed into numerous positions on the vertical concrete screed/decorative rolling tool.

Shown in FIG. 7, in an overhead perspective view, is a stencil pressing roller 35 with pole or handle 13, flex cushion vibration absorbing joint 18, multi-axis connection head 21, vibrator attaching point 23 and the press roller cross frame 32 is shown with attached stabilizing adjustable struts 34. A stencil feed roller 36 is shown attached to the pressing roller 35 by cross roller connecters 37 and also attached by stencil feed roller adjustable struts 38, which are attached to the multi-axis connection head 21.

The invention claimed is:

1. A concrete/cement finishing tool for use on vertical surfaces comprising:

A handle;

A plurality of interchangeable finishing tools attachable to a distal end of the handle;

A multi-axis connection head disposed between the handle and the interchangeable finishing tool;

A flex cushion disposed between the multi-axis connection head and the handle, the flex cushion being adapted to absorb vibrations of the finishing process;

A vibration source disposed between the multi-axis connection head and the flex cushion;

Wherein the interchangeable finishing tool can be rotated to any of a plurality of fixed-angle settings relative to the handle;

Wherein the interchangeable finishing tools are selected from the group comprising: A blade, a trowel, a smoothing roller, and a decorative roller.

2. The concrete/cement finishing tool of claim 1, wherein adjustable struts are attached to the interchangeable tool at a distal end of said adjustable struts and to the handle at a proximate end of said adjustable struts.

3. The concrete/cement finishing tool of claim 1, wherein a stencil feed roller is attachable to the decorative roller by cross-roller connectors and attachable to the multi-axis connection head by feed roller adjustable struts.

4. The concrete/cement finishing tool of claim 1, wherein the screeding blade includes a bottom working surface, a front edge and a rear edge, wherein the front edge and/or the rear is rounded.

5. A method of finishing a vertical concrete/cement surface comprising the steps of:

Providing a concrete/cement finishing tool including a handle, a multi-axis connection head, a flex cushion disposed between the multi-axis connection head and the handle, a vibration source disposed between the multi-axis connection head and the flex cushion; and a plurality of interchangeable finishing tools, selected from the group of: a screeding blade, a smoothing roller, a finishing roller and a decorative roller;

Moving the concrete/cement finishing tool over the vertical concrete/cement surface thereby leveling, smoothing or finishing said vertical concrete/cement surface;

Replacing the one of said interchangeable finishing tools, with a different one of said finishing tools;

Moving the concrete/cement finishing tool over the vertical concrete/cement surface, with said different one of said interchangeable finishing tools contacting the vertical concrete/cement surface, thereby smoothing, finishing or decorating said vertical concrete/cement surface.

* * * * *